US007101441B2

(12) United States Patent
Kennard

(10) Patent No.: US 7,101,441 B2
(45) Date of Patent: Sep. 5, 2006

(54) TOILET PAPER DISPENSER

(76) Inventor: Wayne M. Kennard, 28 Partridge Rd., Lexington, MA (US) 02421

( * ) Notice: Subject to any disclaimer, the term of this patent is extended or adjusted under 35 U.S.C. 154(b) by 188 days.

(21) Appl. No.: 10/378,508

(22) Filed: Mar. 2, 2003

(65) Prior Publication Data

US 2004/0178298 A1 Sep. 16, 2004

(51) Int. Cl.
*B05C 11/10* (2006.01)

(52) U.S. Cl. ..... 118/672; 118/42; 118/43; 242/908

(58) Field of Classification Search ..... 118/672–674, 118/37, 40–43, 709; 242/570, 908
See application file for complete search history.

(56) References Cited

U.S. PATENT DOCUMENTS 3,495,571 A * 2/1970 Evans ..... 118/325
5,887,759 A * 3/1999 Ayigbe ..... 222/192
6,457,434 B1 * 10/2002 Lazar ..... 118/32
6,613,144 B1 * 9/2003 Loertscher et al. ..... 118/302
6,708,845 B1 * 3/2004 Weng ..... 222/61
2002/0170649 A1 * 11/2002 Butterworth et al. ..... 156/64
2003/0132314 A1 * 7/2003 Neuendorf ..... 239/333

* cited by examiner

*Primary Examiner*—George Koch

(57) ABSTRACT

A system and method for dispensing roll material is described that substantially prevents toilet paper runaway and is useful in reducing irritation caused by using dry toilet paper. In one embodiment, the dispenser has a structure that has a thin, but strong curved, rigid arm with a tooth that is biased to engage the toilet paper roll in such a manner that it will only permit the roll to turn only in one direction. If the roll is attempted to be turned in the opposite direction, the tooth, which is disposed toward the roll, will engage the roll and prevent rotation in the second direction without substantially damaging the toilet paper on the roll. In a second embodiment, the toilet paper dispenser will dispense a predetermined amount of toilet paper into a receiver that has a sufficient size that it will fold over onto itself a predetermined number of times. Once the predetermined amount of toilet paper is disposed in the receiver, the system will dispense a measured amount of lotion, cream, or other type of cleansing liquid that will provide not only cleansing of the desired tissue area but also act as a lubricant for the toilet paper so that it will not irritate the tissue.

9 Claims, 4 Drawing Sheets

TOILET PAPER DISPENSER

The present invention relates to systems and methods that are used to dispense toilet paper from a roll. More specifically, the present invention relates to systems and methods that are used for dispensing toilet paper from a roll that will prevent toilet paper runaway and reduces the irritation of the toiler paper when it is used.

BACKGROUND OF THE INVENTION

After the invention of the toilet, there have been a variety of methods that have been devised to cleanse the person who used the toilet. These methods have been from the use of leaves and newspaper to cloth materials. However, the advent of toilet paper on a roll has become the standard in Western culture for people to cleanse him-/herself.

Anyone who has traveled, and not even extensively, knows that toilet paper comes in a variety of textures. It may range from the alleged softest "Charmin" to some that appear (and feel) as course as burlap. Further, virtually all toilet paper that is used is dry. By this, it is meant that the toilet paper is typically dry paper on a roll that is metered out by the user as needed to cleanse him-/herself.

Whatever the texture of the toilet paper, in its primary use, it will come in contact with sensitive body tissue. In some cases, however, this sensitive body tissue may be in an irritated condition even before the toilet paper comes in contact with it. When the tissue is in such a condition, it does not matter how soft the toilet paper may be it will further irritate the area and the person will experience greater discomfort in using the toilet paper but there is no alternative to cleanse them.

If someone has traveled to France and stayed in a hotel or home, they would be aware that the French have sought to solve at least the irritation problem by the elimination of the use of toilet paper altogether. The French use a "Bidet" that operates by spraying water at the tissue area to be cleansed that may later be dried, for example, with a towel. This method does not require the repetitive rubbing of dry toilet paper over the soiled area in order to cleanse the tissue.

Although the "Bidet" has many advantages with regard to the comfort it provides the user, its use has not caught on significantly in most locales in the world. It is observed that in those locales where there are Western-style toilet facilities, the method of choice in both commercial and residential settings is for people to cleanse themselves with dry toilet paper.

Another problem, particularly for commercial properties, is the loss of money because of waste associated with toilet paper. This waste may be because of the (i) excessive use of paper, (ii) intentional, unnecessary removal of excessive amounts of paper from the roll, or (iii) unintentional removal of excessive amounts of paper from the roll caused by roll runaway. These are controllable but the solutions are not particularly desirable for the normal user.

Two solutions to help solve the waste problem are to limit the amount that the toilet paper roll may turn and the second is to use small, individual paper sheet instead of a roll. According to the first solution, the dispenser will permit the roll to turn a set number of revolutions then it will stop. This will provide the user a set number of toilet paper sections before they must be separated from the roll. In order for the user to accumulate an adequate amount of toilet paper to cleanse him-/herself, it may be necessary to remove several pulls worth of toilet paper. The second solution includes a dispenser that is filled with interfolded, individual toilet paper sheets. The sheets are fitted together such that as one sheet is removed, a portion of the next sheet will extend from the dispenser. In order for a user to obtain an adequate number of sheets, he/she must pull a desired number of sheets from the dispenser.

The two solutions are more appropriate for locations such as schools and public facilities where the change of abuse is high. However, they are not as desirable for residential or commercial buildings where the risk of such abuse is low, and it is particularly frustrating the user.

The third cause of waste indicated above, the unintentional removal of excessive amounts of paper from the roll caused by roll runaway, is very controllable and there are methods currently available that attempt to solve the problem. These methods do not attempt to limit the amount of toilet paper that a user may obtain, but focus on the express issue of runaway. One method to solve this problem is to use of an unbalanced toilet paper roller that fits in a standard toilet paper dispenser. Runaway is reduced when the toilet paper roll is spun rapidly and the unbalanced nature of the roll will cause it to stop spinning much more rapidly than if a balanced roller was used.

A second method to prevent unintentional runaway is to provide a curved, hinged metal plate that extends from the back of the dispenser structure and rests on top of he toilet paper roll. Hotels frequently use this type of dispenser. The structure relies on the weight of the curved metal plate to prevent runaway. Therefore, the heavier the plate, the greater the stopping power it will provide. However, the greater the weight, the greater the chance the toilet paper will separate from the roll at an undesired location. Accordingly, there must be a compromise between the weight of the plate and the desired stopping power of plate to prevent runaway.

The two methods just described provide some degree of runaway prevention, but considerable runaway can still take place. There is the desire to provide greater degrees of runaway prevention yet still permit the toilet paper roll to turn as freely as possible.

The present invention solves the problems of the past and provides a toilet paper dispenser that prevents toilet paper runaway and discomfort that may exist from the use of dry toilet paper.

SUMMARY OF THE INVENTION

The present invention is a system and method for dispensing toilet paper in which toilet paper runaway is significantly prevented and the irritation caused by dry toilet paper is significantly reduced.

The first embodiment of the present invention will greatly reduce toilet paper runaway. This embodiment has a structure that has a thin, but strong curved, rigid arm that has a tooth at or near the distal end that engages the toilet paper roll in such a manner that it will only permit the roll to turn only in one direction without substantial damage to the toilet paper on the roll. If the roll is attempted to be turned in the opposite direction, the tooth will engage the roll and prevent rotation in the second direction without substantial damage to the toilet paper on the roll. The arm is biased sufficiently so that it will prevent runaway yet permit the toilet paper roll to easily turn when in use.

In a second embodiment of the present invention, the toilet paper dispenser will dispense a predetermined amount of toilet paper into a receiver that has a sufficient size that it will fold over itself a predetermined number of times. The toilet paper may be mechanically separated from the roll or the user will separate it. Once the predetermined amount of toilet paper is disposed in the receiver, the system will dispense a measured amount of lotion, cream, or other type of cleansing liquid that will provide not only cleansing of the desired tissue area but also act as a lubricant for the toilet paper so that it will not irritate the tissue. In this embodiment, the lotion, cream, or cleansing liquid will be dispensed onto the top surface of the folded toilet paper. The user may then retrieve the toilet paper with the cleansing material on it from the receiver and apply it to cleanse the soiled area.

An object of the present invention is to provide a system and method for controlling tissue paper runaway if the toilet paper roll is spun very rapidly.

Another object of the present invention is to provide a system and method that will dispense toilet paper and a cleansing liquid for the user to cleanse him-/herself.

These and other objects of the present invention will be described in greater detail in the remainder of the specification referring to the drawings.

DETAILED DESCRIPTION OF THE DRAWINGS

The present invention is toilet tissue dispenser that in a first embodiment prevents to a large degree the waste of toilet paper due to toilet paper runaway when the roll is spun to rapidly. The present invention in a second embodiment is a toilet paper dispenser that provides toilet paper and cleansing liquid for cleansing a soiled area of the user.

Figure 1:
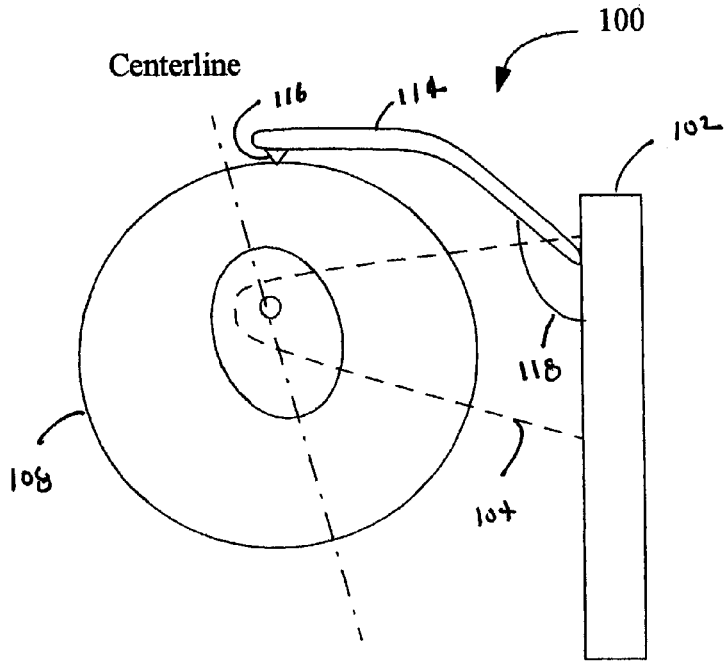
FIG. 1 is a side perspective view of a first embodiment of the toilet paper dispenser of the present invention.

Referring to FIG. 1, a side perspective view of the first embodiment of the present invention is shown generally at 100. Also referring to FIG. 2, a top perspective view of the first embodiment is shown generally at 200. Referring to these two Figures, the first embodiment of the present invention will be described.

The support structure of the first embodiment of the present invention has certain conventional features. Specifically, the support structure of the present invention has a back rectangular support plate 102 that connects to the wall in a conventional manner. For example, the back rectangular support plate may connect to the wall with screws, pins, slide connections, glue, or other conventional types of connection methods. It is understood that although the back support plate is shown as a rectangular plate, it may have other geometric shapes, and it my be other than flat and still be within the scope of the present invention.

Figure 2:
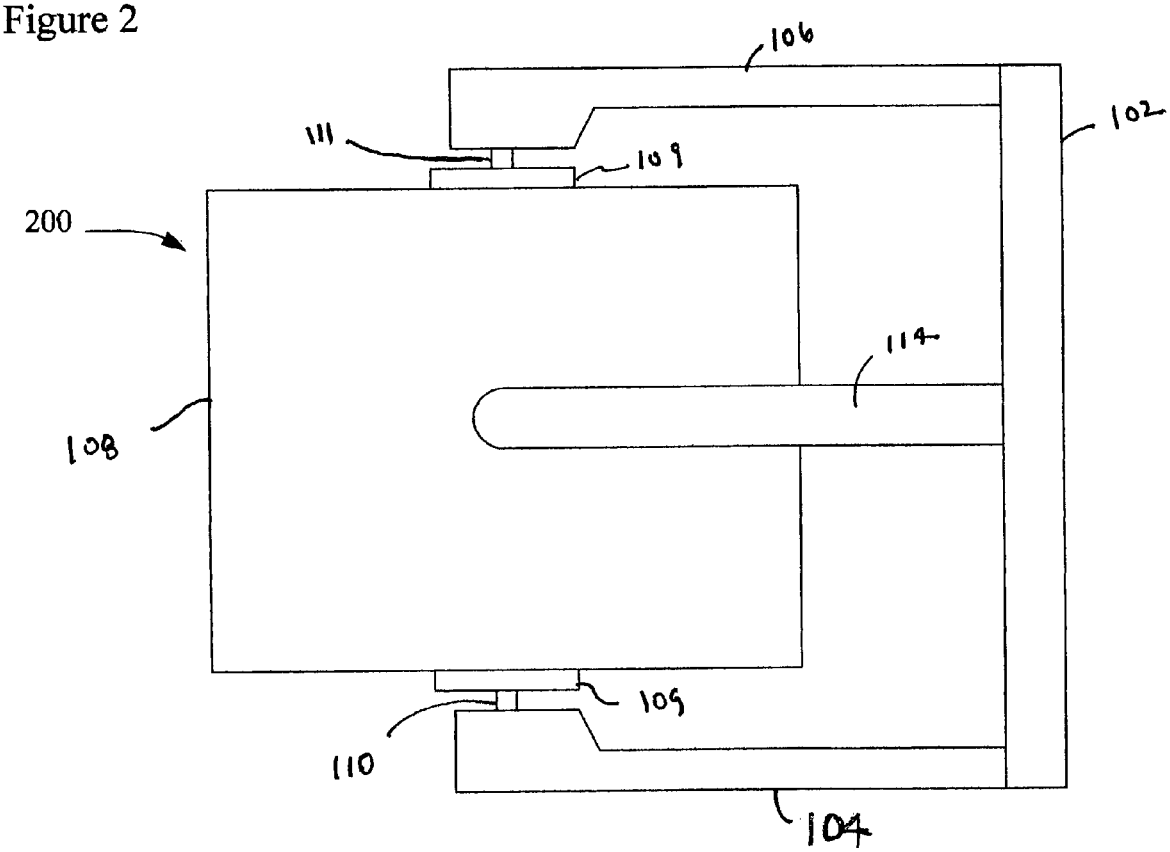
FIG. 2 is a top perspective view of the first embodiment of the toilet paper dispenser of the present invention that is shown in FIG. 1.

Extending perpendicularly from the each side of back rectangular support plate 102 are side supports 104 and 106. The placement of the side supports 104 and 106 with respect to back rectangular support plate 102 is to properly space them to engage the ends of toilet paper spool 109. Each of the side supports near their respective distal ends has a section that is adapted to rotatably engage one of the ends of toilet paper spool 109. Either one or both of the side supports may be hinged or movable so that it will permit the toilet paper spool to be inserted between them and then engaged by the side supports. While FIGS. 1 and 2 show a preferred shape of side supports 104 and 106 of the present invention, it is understood that the side supports may have a different shapes and still be within the scope of the present invention as long as the side supports will rotatably engage the ends of toilet paper spool 109.

Toilet paper spool 109 extends between side supports 104 and 106. Toilet paper spool 109 has nipples 110 and 111 extending from respective ends of the spool. The nipples rotatably engage side supports 104 and 106. Toilet paper roll 108 is disposed on toilet paper spool 109.

As is better seen in FIG. 1, the main body of toilet paper spool 109 has an oval cross-sectional shape. Accordingly, the shape is asymmetrically disposed about the longitudinal rotational axis of the spool. This will mean that toilet paper spool 109 will rotate about the longitudinal axis through nipples 110 and 111 in an unbalanced manner. Thus, if the toilet paper roll is rotated and released, it will eventually stop rotating much more rapidly because of the asymmetrical toilet paper spool than if the spool had a circular cross-section that was symmetrical with respect to the nipples.

The present invention includes bias arm 114 that has a proximal end that connects to back rectangular plate 102. Bias arm 114 is rotatable about its connection point to the back rectangular plate 102. Bias arm 114 is biased toward toilet paper roll 108 by bias member 118. Bias member 118 may be a spring or other type of structure that will controllably bias arm 114 toward toilet paper roll 108.

The surface or side of bias arm 114 that is to toward toilet roll 108 has projection 116 in the form of a tooth extending from it near the distal end of the arm. Tooth 116 is positioned on the under surface of bias arm 114 so that when bias arm 114 is biased toward toilet roll 108, it will contact the toilet roll no matter the amount of toilet paper on the roll. That is, tooth 116 will contact the toilet paper of the roll when the roll and until all of the toilet paper is removed from the roll. Although the FIGS. 1 and 2 show bias arm 114 as thin in width and containing only one projection 116, it is understood that the bias arm my be wider and may include more than one projection and still be within the scope of the present invention.

According to the present invention, when bias arm 114 with tooth 116 is biased toward toilet paper roll 108, tooth 116 will engage toilet paper roll 108 so that it can rotate under the pressure exerted on it by the bias arm and tooth even in light of toilet paper spool 109 being unbalanced. The pressure also is of a level that it will not cause the toilet paper to tear along its perforated lines based solely on such pressure. Accordingly, toilet paper may be pulled from the toilet paper structure of the present invention without the paper prematurely tearing at undesired locations. However, the pressure exerted by the bias arm and tooth will prevent to a large degree toilet paper runaway if the toilet paper is spun rapidly.

Referring primarily to FIG. 1, when the present invention is used, bias arm 114 and tooth 116 will engage toilet paper roll 108 and permit the roll to rotate in one direction without substantially damaging the toilet paper on the roll. In FIG. 1, this direction will be counterclockwise. This rotation will be under pressure but it will smoothly rotate. Depending on the softness of the toilet paper, when the toilet paper roll is rotated to remove toilet paper, tooth 116 my form a depression line in the paper. If the toilet paper is attempted to be rotated in the opposite or clockwise direction in FIG. 1, the tooth will engage the toilet paper roll and in all likelihood tear the paper.

Given unbalanced toilet paper spool 109 and bias arm 114 with tooth 116, after the removal of toilet paper from toilet paper roll 108, the roll will not rest in a position that centerline 112 will perpendicular to the ground as would case due to gravity if bias arm 114 with tooth 116 were not present. According to the present invention, typically, after toilet paper has been removed and the roll is released, the roll will rotate and in this rotation the unbalanced spool will seek to have centerline 112 perpendicular to the ground but tooth 116 will engage the roll when it attempts to rotate on the clockwise direction resulting in the roll having a resting position with centerline 112 at an angle to the ground as shown in FIG. 1.

Noting the foregoing, when the system and method of the invention are used, toilet paper runaway is prevented to a great degree without the problems of the past.

The second embodiment of the present invention is a toilet paper dispenser that will permit the user to have a cleansing liquid provided to the toilet paper so that the user may conveniently use the cleansing liquid to clean a soiled area. The second embodiment of the present invention will be described referring to FIGS. 3–5.

Figure 3:
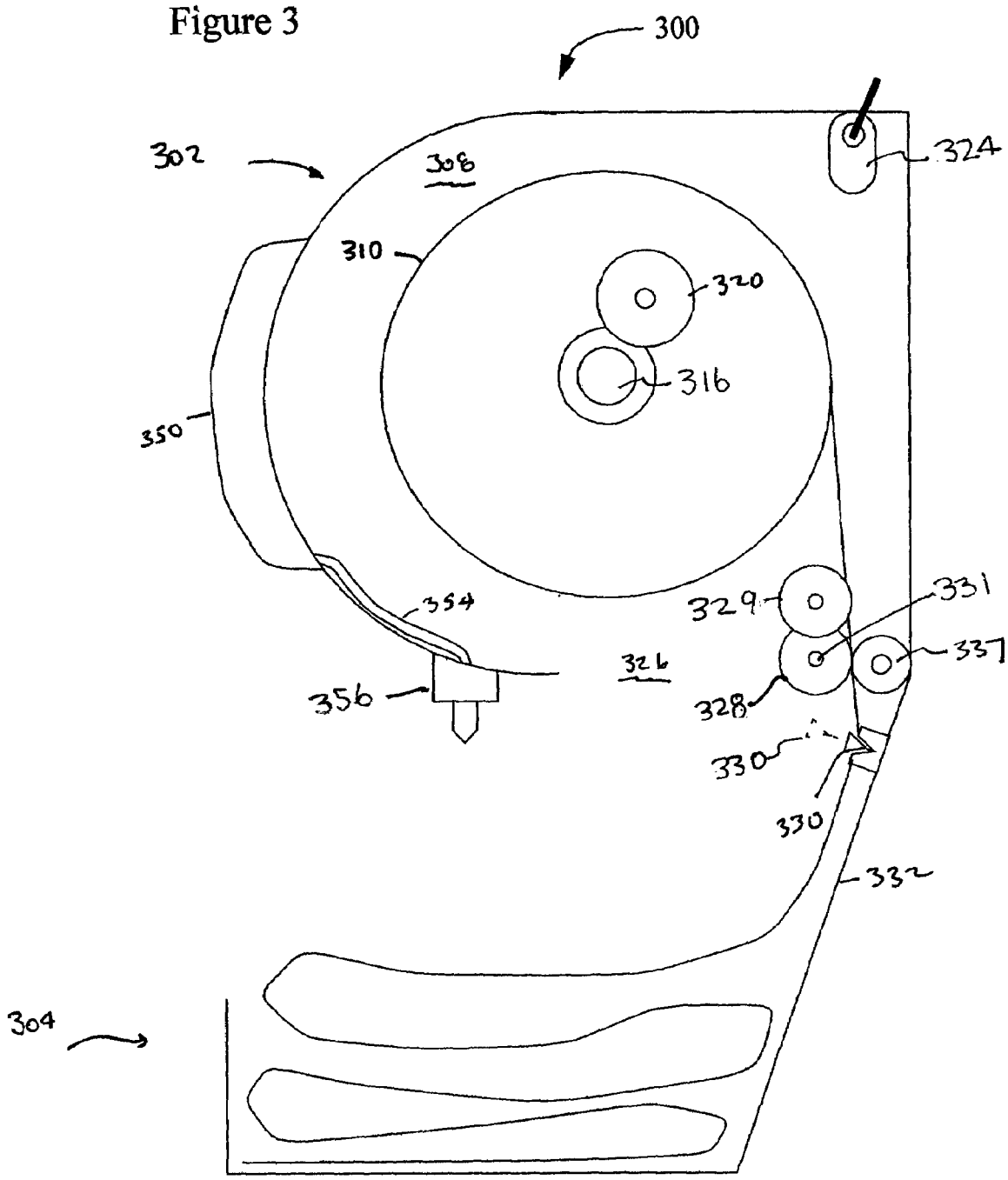
FIG. 3 is a side perspective view of a second embodiment of the toilet paper dispenser of the present invention.
Figure 4:
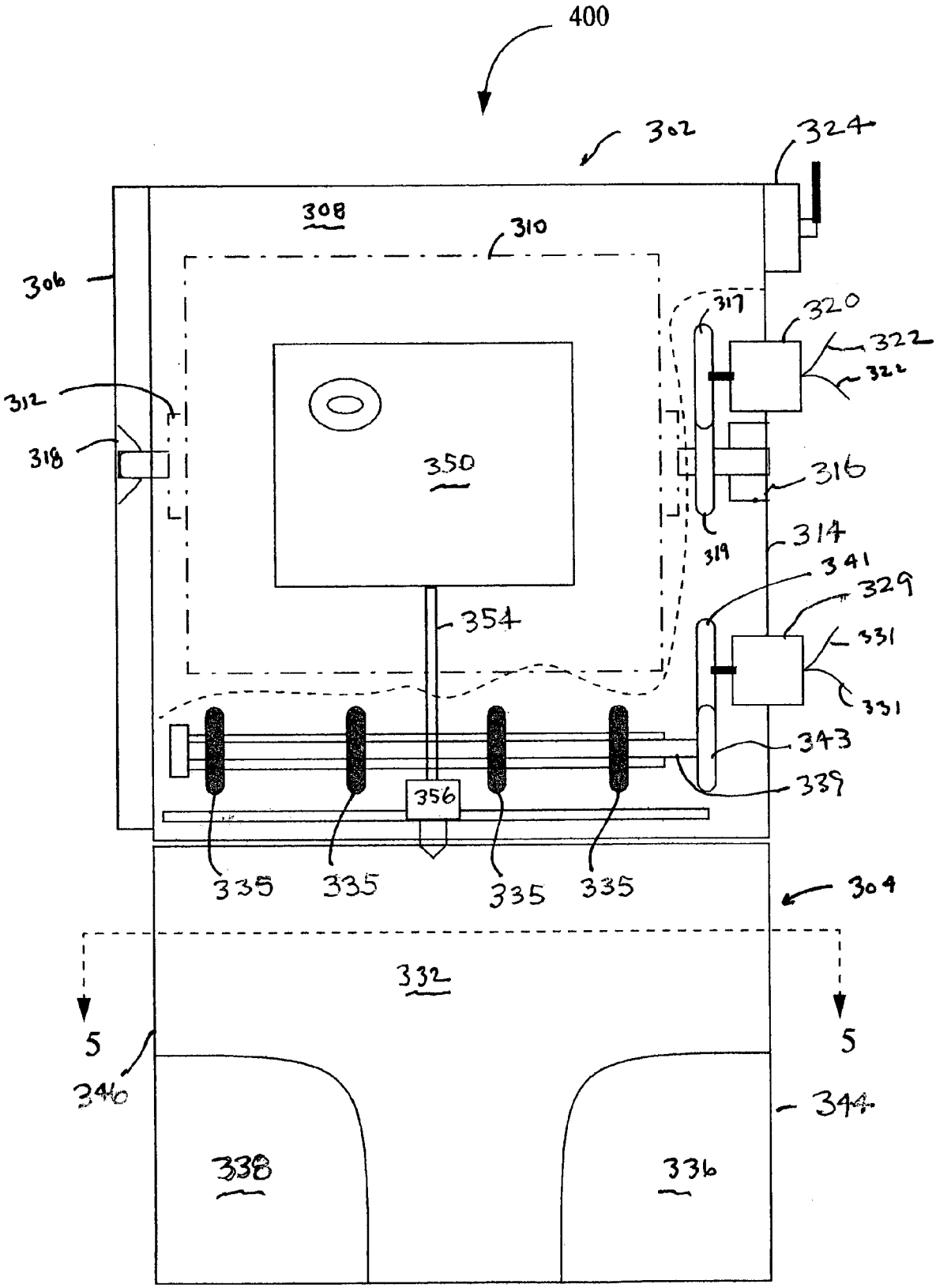
FIG. 4 is a front perspective view of the second embodiment of the toilet paper dispenser of the present invention that is shown in FIG. 3.

FIG. 3, generally at 300, shows a side perspective view of the present invention with a portion of the top section cut away to show the interior of the second embodiment of the present invention. FIG. 4, generally at 400, shows a front perspective view of the present invention shown in FIG. 3. And, FIG. 5, generally at 500, shows a top perspective view of the bottom section of the present invention along 5—5 of FIG. 4.

The second embodiment has top section 302 and bottom section 304. Top section 302 houses and dispenses the toilet paper, and includes the reservoir for the cleansing liquid. Bottom section 304 includes the tray that receives the toilet paper and cleansing liquid from top section 302. Each of these sections will be described and the method by which the sections work together to provide the toilet paper and cleansing liquid to the user will be described.

Top section 302 has hinged door 306 that is shown on the left side in FIG. 4. Preferably, door 306 is hinged along the back edge. The door may be opened to permit toilet paper rolls to be loaded into the top section. The front edge of the hinged door and edge of the top section that it contacts when it closed, latch or otherwise connect to keep the door locked or latched in place when the door is closed.

When the hinged door 306 is closed, toilet paper chamber 308 is formed. Chamber 308 will house toilet paper roll 310. Within chamber 308, toilet paper spindle 312 is rotatably connected to interior of wall 314 of top section 302 at 316. Although the rotatable connection at 316 is strong enough to support spindle 312 and toilet paper roll 310, the distal end of the spindle 312 rotatably engages hinged door 306 when the door is closed. To accommodate the rotatable engagement of the distal end of spindle 312, hinged door 306 has spindle receiver 318.

Interior wall 314 of top section 306 has stepping motor 320 attached to it. The stepping motor connects to the spindle 312 in a geared or other equivalent relationship so that the motor can controllably turn the spindle in a predetermined direction. Gears 317 and 319 connect steppe motor 320 to toilet paper spindle 312. Electrical wires 322 connect to a power source for powering stepping motor 320. The electrical wires connect to an alternating power source or a direct power source, such as a battery (not shown).

Stepping motor 320 is connected to and controlled by, toilet paper controller 324. The controller has a plurality of setting to control the amount of toi let paper that is dispensed from the toilet paper roll when it is engaged. The amount toilet paper that is dispensed is controllable because different users desire different amounts of toilet paper to clean soiled areas.

Toilet paper controller 324 is positioned on top section 302 at a convenient location so that the user my easily see it and its control positions. As an example, toilet paper controller 324 may be set to a first position that will cause twenty toilet paper sections to be dispensed or their equivalent in linear measurement, and also cause the dispensing of a cleansing liquid onto the toilet paper. If the paper controller is set to a second position, thirty toilet paper sections will be dispensed along with the cleansing liquid. Further, if the paper controller 324 is set to a third position, twenty-five toilet paper sections will be dispensed without any cleansing liquid dispensed. It is to be understood that any amount of toilet paper may be programmed to be dispensed at any given setting of toilet paper controller 324 and still be within the scope of the present invention.

Toilet paper roll 308 will decrease in diameter as more toilet paper is removed from the roll. However, the amount of toilet paper that is dispensed from the roll each time is a measured amount so the size of the roll will not affect the amount that is being dispensed at any given time.

The bottom of top section 302 has opening 326 through which the distal end of toilet paper roll 308 extends. Powered roller 328 engages the end or portion of the toilet paper roll that extends through opening 326 so that a controlled amount of toilet paper is dispensed to the bottom section 302 of toilet paper dispenser 300. Roller 328 is generally powered by stepper motor 329. Gears 341 and 343 connect stepper motor 329 to powered roller 328. Stepper motor 329 is driven at the same time as spindle 312 by stepping motor 320 so that there is not sufficient tension on the toilet paper roll to tear the toilet paper. Stepper motor 329 has wires 331 that are connected to an AC or DC power source. Stepper motor may be controlled by toilet paper controller 324.

Powered roller 328 may be configured to include shaft 339 that have spaced rubber wheels 335 disposed on the shaft. When the shaft is turned the wheels grip the toilet paper against free turning rubber coated shaft 337 to dispense the toilet paper to bottom section 304.

In another embodiment of the present invention, stepping motor 320 is eliminated and powered roller 328 will pull toilet paper from a free spinning toilet paper roll 308. This embodiment is operable as long as the tension on the toilet paper caused by turning the toilet paper remains less than the breaking strength of the toilet paper. This will generally be the case as long as the toilet paper roll freely turns when powered roller is engaged. In this embodiment, stepper motor 329 may be controller by toilet paper controller 324.

At the back of opening 326 is cutter 330. Cutter 330 may be a conventional cutter that has a blade that cuts the toilet paper across its width. In FIG. 3, cutter 330 is shown in the cutting position and in phantom in the ready position. The cutter is present in both embodiments of the second embodiment of the present invention. In these embodiments, cutter 330 is at the back of opening 326 on the back wall of the top section disposed just below the powered roller 328. Cutter 330 may be manually operated or electrically powered and still be within the scope of the present invention.

Bottom section 304, as stated, connects to top section 302 at the back wall. Bottom section 304 form a toilet paper receiver. The bottom section includes forward slanted back 332, sidewalls 344 and 346 bottom 334 with U-shape cutout 340 and retaining lips 336 and 338.

Back 332 is slanted to facilitate the stacking of the measured amount of toilet paper that is dispensed at any given time. When toilet paper is being dispensed, sidewalls 334 and 336 assist in retaining the toilet paper in the bottom section. Lips 336 and 338 also assist in retaining the toilet paper in the bottom section along with its primarily purpose which is to assist in the toilet paper folding in a particular manner so that it may receive a portion of cleansing material that may be applied to an irritated location of the body.

Figure 5:
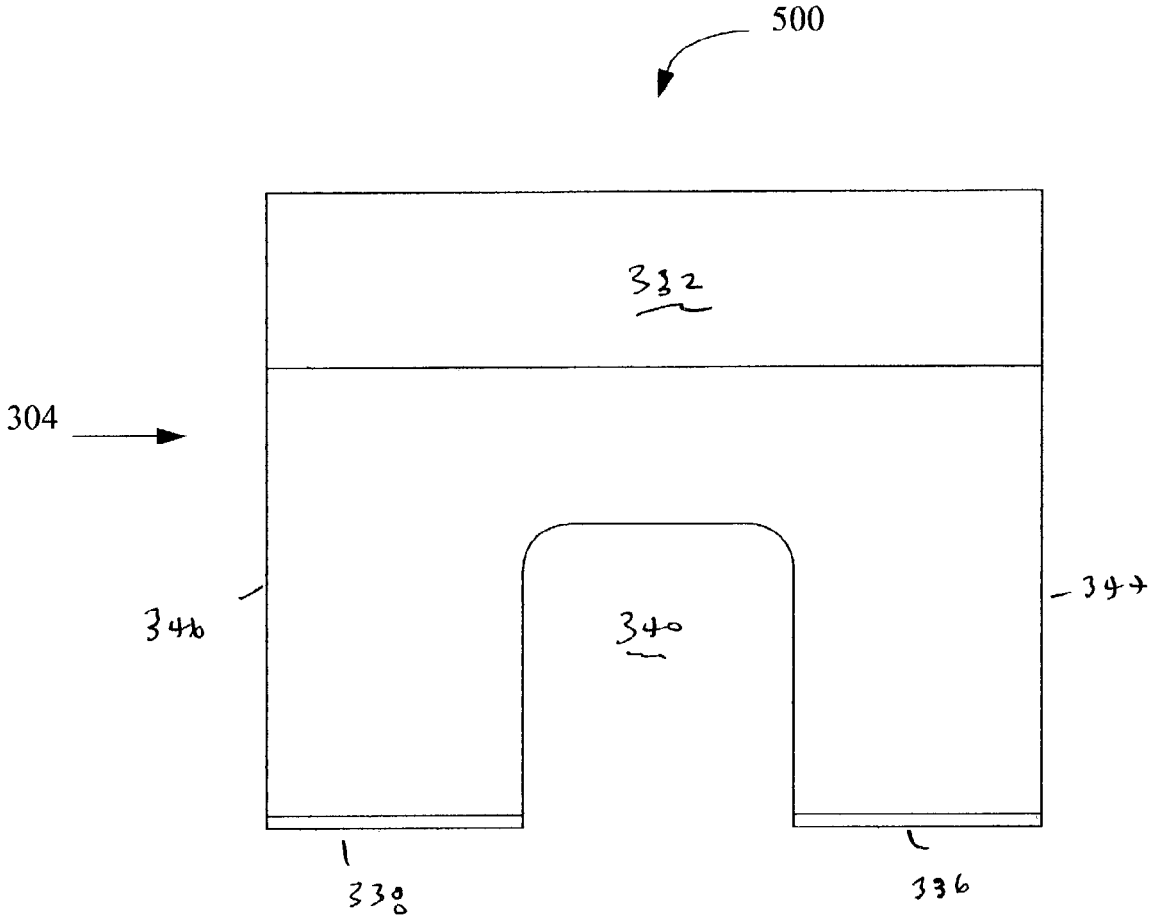
FIG. 5 is a top view of the bottom tray of the second embodiment of the present invention along 5—5 of FIG. 4.

Referring to FIG. 5, U-shaped cutout 340 is provided so that a user can easily retrieve the dispensed toilet paper that includes the cleansing liquid.

Referring to FIGS. 4 and 5, the front of top section 302 has cleaning liquid reservoir 350 attached to it. Cleansing liquid line 354 connects between reservoir 350 and dispense nozzle 356. Reservoir 350 has manual pump 358 that the user presses to dispense cleansing liquid from the reservoir through line 354 and nozzle 356 onto the toilet paper dispensed in bottom section 302.

Preferably, the pump is electrically powered and the cleansing liquid will be automatically dispensed from reservoir 350 a timed period after the toilet paper has been dispensed from top section 302 to bottom section 304. However, it is understood that the dispensing of the cleansing liquid onto the tissue folded in the bottom section will take place if either the manual or automatic embodiment is used.

In manual operation, the user will activate toilet paper controller 324 to dispense the desired amount of toilet paper from top section 302 to bottom section 304. This will result in the toilet paper being folded in the bottom section. The toiler paper is then cut across its width by cutter 330. Cutter 330 may be manually or automatically operated and still be within the scope of the present invention. Next the user will push-on button 358 to pump and dispense the cleansing liquid onto the toilet paper. Lastly, the user will remove the toilet paper from the bottom section and use it. These steps may be practiced a number of times until the user has cleansed him-/herself.

In automatic operation, the user will also activate toilet paper controller 324 to dispense the desired amount of toilet paper from top section 302 to bottom section 304. The toiler paper is then cut across its width by cutter 330 a timed period after dispensing the toilet paper. Again, it is within the scope of the present invention that the cutter may be automatically or manually operated, but in this embodiment it is preferably automatically operated. A predetermined period after the toilet paper has been dispensed to the bottom section and cut, the pump, preferably, is automatically activated to dispense a measured amount of cleansing liquid onto the toilet paper. The user will repeat these steps until he/she feels cleansed.

Thee terms and expressions that are use herein are meant for description not limitation. It being recognized that there may be minor changes or modifications that must take place and be within the scope of the present invention.

The invention claimed is:

1. A dispenser usable with roll material, comprising:

a top section for housing rotatably disposing roll material, with the top section further comprising, a base for facilitating connecting the dispenser to a mounting structure, first roll mounting structure disposed from a first side of the base, with the first roll mounting structure being capable of rotatably receiving a first end of a roll spindle, second roll mounting structure disposed from a second side of the base opposite the first side, with the second roll mounting structure being capable of rotatably receiving a second end of the roll spindle, roll spindle for receiving roll material to be dispensed from the dispenser, the roll spindle being rotatably disposed between the first and second roll mounting structures, controller for causing a predetermined amount of roll material to be dispensed therefrom to a bottom section, drive means under control of the controller and engaging the roll spindle for causing rotation of the roll spindle when activated by the controller, cutter for cutting the roll material across a width of the roll material to separate roll material dispensed to the bottom section from the roll material in the top section, and cleansing system including at least a reservoir, a dispensing nozzle connected to the reservoir, and a pump connected to the reservoir for pumping cleansing material from the reservoir through the nozzle onto roll material dispensed in the bottom section; and the bottom section for receiving roll material from the top section, with the bottom section having shape that will facilitate the dispensed roll material to fold on itself to form a stack and position the stack to receive the cleansing material dispensed from the dispensing nozzle.

2. The dispenser as recited in claim 1, wherein the controller controls the drive means and cutter.

3. The dispenser as recited in claim 2, wherein the pump is manually operated.

4. The dispenser as recited in claim 1, wherein the controller controls the drive means, cutter, and pump.

5. The dispenser as recited in claim 4, wherein the pump is automatically operated.

6. The dispenser as recited in claim 1, wherein the drive means includes a motor.

7. The dispenser as recited in claim 1, wherein the cutter includes a cutter that traverses the width of the roll material to cut the roll material.

8. The dispenser as recited in claim 1, wherein the cutter includes a cutter with a blade of sufficient width cut the roll material by engaging the entire width at one time.

9. The dispenser as recited in claim 1, wherein the connection line connects between the reservoir and the nozzle.

* * * * *